United States Patent [19]

Düringer

[11] Patent Number: 4,610,152

[45] Date of Patent: Sep. 9, 1986

[54] COMBINATION LOCK FOR THE SECURING OF SKIS, BICYCLES OR THE LIKE

[75] Inventor: Rudi H. Düringer, Wuppertal, Fed. Rep. of Germany

[73] Assignee: S. Franzen Söhne (GmbH & Co.), Solingen, Fed. Rep. of Germany

[21] Appl. No.: 592,154

[22] Filed: Mar. 22, 1984

[30] Foreign Application Priority Data

Mar. 23, 1983 [DE] Fed. Rep. of Germany ..... 3310499
Mar. 19, 1984 [DE] Fed. Rep. of Germany ..... 3410047

[51] Int. Cl.[4] ..... E05B 37/18

[52] U.S. Cl. ..... 70/30; 70/312; 70/317; 70/322; 70/445

[58] Field of Search ..... 70/312, 20, 30, 315–318, 70/329–332, 442–446, 306, 308, 311, 309, 321–324

[56] References Cited

U.S. PATENT DOCUMENTS

| | | | |
|---|---|---|---|
| 901,972 | 10/1908 | Kone | 70/330 |
| 3,411,330 | 11/1968 | Atkinson | 70/315 |
| 3,597,945 | 8/1971 | Feinberg | 70/318 X |
| 3,677,042 | 7/1972 | Atkinson | 70/312 X |
| 4,302,955 | 12/1981 | Kawakami | 70/30 |
| 4,327,566 | 5/1982 | Ling | 70/312 |
| 4,487,043 | 12/1984 | Milles | 70/312 |
| 4,503,691 | 3/1985 | Li | 70/312 |

FOREIGN PATENT DOCUMENTS

| | | | |
|---|---|---|---|
| 1678126 | 10/1971 | Fed. Rep. of Germany . | |
| 2659189 | 7/1978 | Fed. Rep. of Germany | 70/312 |
| 550401 | 12/1922 | France | 70/312 |
| 883797 | 12/1961 | United Kingdom | 70/30 |
| 1245178 | 9/1971 | United Kingdom | 292/DIG. 37 |
| 2058197 | 4/1981 | United Kingdom | 70/312 |

*Primary Examiner*—Gary L. Smith
*Assistant Examiner*—Lloyd A. Gall
*Attorney, Agent, or Firm*—Martin A. Farber

[57] ABSTRACT

A combination lock adapted for securing skis, bicycles and the like, having a lock housing in which setting disks for setting a lock combination are rotatably supported and from which housing there extends fixed thereto, one end of a loop, the other, free end of which is insertable into an insertion channel in the lock housing and is engageable by the inners of the lock. In this respect within the insertion channel of the lock housing a latch is provided for catching the free end of the loop. The latch is seated, displaceable against spring biasing, on a setting-disk mounting shaft and, when the lock combination is correctly set, is disengageable, by a collar on the setting-disk mounting shaft which continues into an outwardly extending actuating button, by displacement together with the mounting shaft.

12 Claims, 15 Drawing Figures

FIG. 6
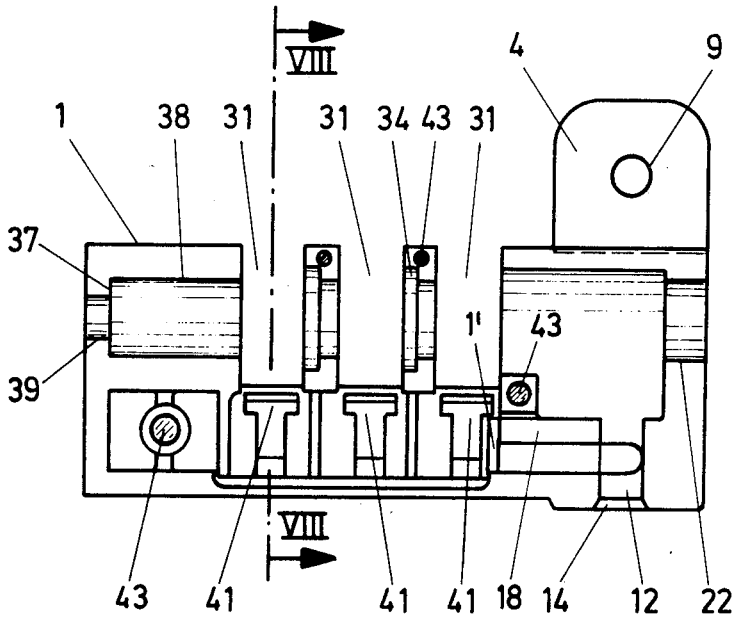
FIG. 8
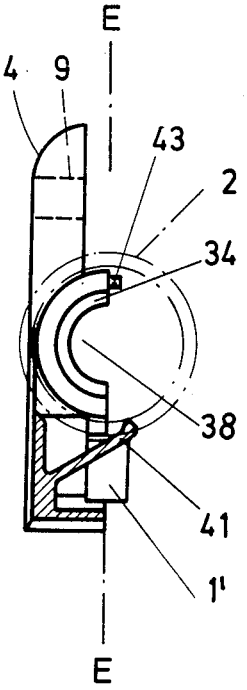
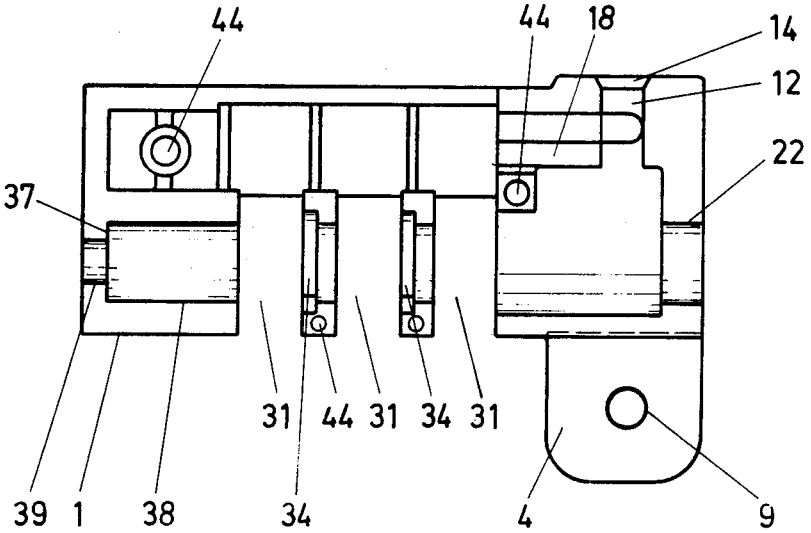
FIG. 7

FIG.9
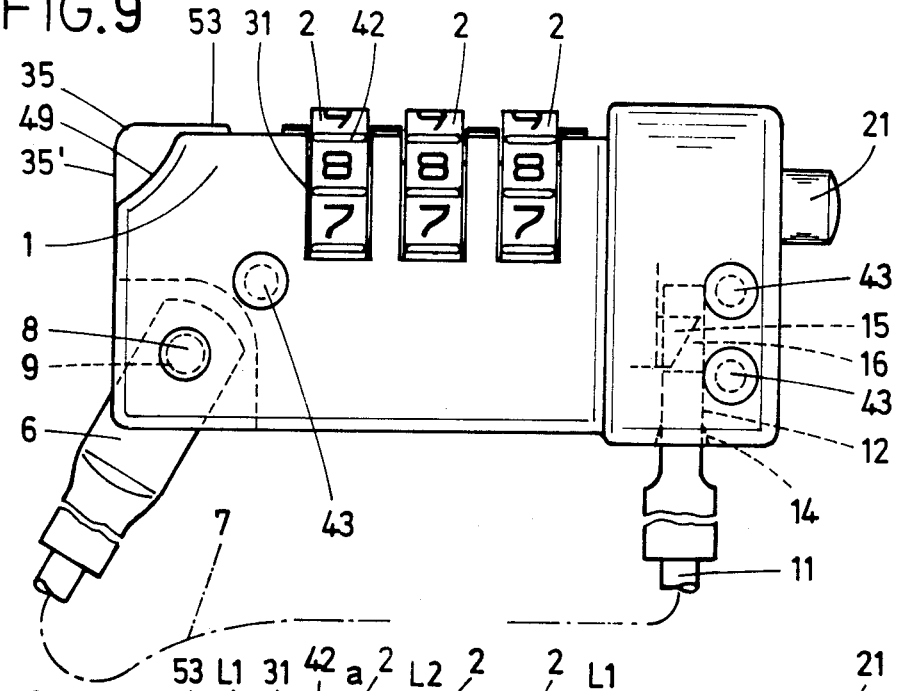
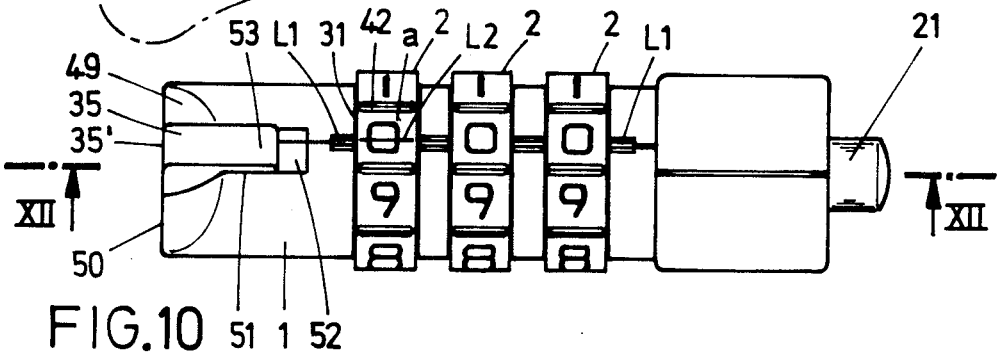
FIG.10
FIG.11
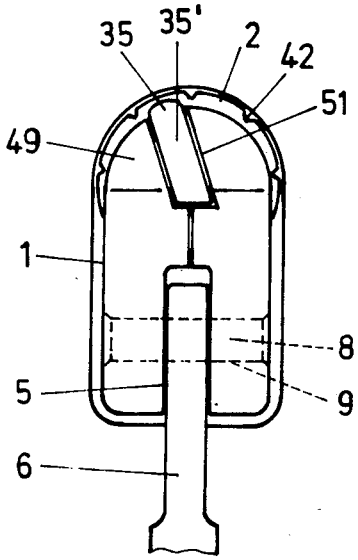

COMBINATION LOCK FOR THE SECURING OF SKIS, BICYCLES OR THE LIKE

FIELD OF THE INVENTION

The present invention relates to a combination lock for securing skis, bicycles or the like, having a lock housing which rotatably supports setting disks and from which there extends, fixed thereon, one end of a loop whose other, free end can be inserted into a channel in the lock housing and is grasped by a lock member.

BACKGROUND OF THE INVENTION

A combination lock of this kind is known from Federal Republic of Germany OS No. 16 78 126. In that case the channel is developed as a central bore extending in the longitudinal central axis of the lock housing which is developed with substantial rotational symmetry. The setting disks, which are provided with symbols on their circular surface, surround this channel-forming section of the housing. On the inside they have locking depressions for locking members which are floatably mounted in radial bores in the wall of the channel. The channel-side end thereof extends as a blocking protrusion into annular grooves of the free end, which is developed as an insertion pin. The inner sides of the setting disks have entrance spaces. If these entrance spaces are opposite the locking member, the lock can be opened. The individual detent positions of the setting disks are defined by spherical bodies under spring action. The construction of this combination lock is relatively expensive. In addition, the tensile stress of the loop acts directly on the small, pin-like blocking members. In order to change the combination, a new unit is required.

It is the object of the invention to improve a combination lock of this kind in a manner which is simple to manufacture so that the stresses acting on the loop do not act on the parts which produce the locking function while, on the other hand, there is assured operation which is favorable in use for typical uses of a lock.

SUMMARY OF THE INVENTION

This object is achieved by providing within the insertion channel (12) of the lock housing (1) a latch (15) for catching the loop free end (6), which latch (15) is seated, displaceable against spring action (spring F1), on a setting-disk mounting shaft (3) and, when the lock combination is correctly set, is disengageable by a collar (20) on the setting-disk mounting shaft (3) which continues into an outwardly extending actuating button (21), by displacement together with the setting-disk mounting shaft.

As a result of this development, there is obtained a combination lock of this type which is of particularly increased value in use, where the loop free end is gripped via a latch. For this it is immaterial whether the combination is set correctly or not. The correct grouping of the setting disks is necessary only for release of the loop.

The latch is developed simply as a slide latch. For the mounting thereof there is employed a structural part which is present in any event, namely the mounting shaft for the setting disks. Unlatching is effected via an outwardly protruding actuating button. The latter extends from a collar which is fixedly attached to the setting disk mounting shaft. When the combination is correctly set, the actuating button together with the setting-disk mounting shaft can be displaced out of its basic position against spring action. The latch is thereby disengaged and the loop is opened. The operation is facilitated by the fact that the fixed end is fastened opposite the insertion channel. The remaining section of the lock housing is thus available for firm gripping of the relatively small combination lock. However, the displacement which makes possible a change in the combination can also be conveniently effected in the manner that, coaxial to the setting-disk mounting shaft, there is provided, on the side opposite the actuating button, a push button for changing the combination, which button is continued to form a collar which lies on the inner side of the lock housing. Against this collar rests the last of the spring-loaded locking sleeves, which are guided displaceably on the setting-disk mounting shaft. It is advantageous for the collar to be developed as a cup-shaped bushing and to support the end present there of the setting-disk mounting shaft, the bottom of the cup lying at a distance from the front end of the setting-disk mounting shaft which corresponds to the actuating stroke of the latch. The free passage created here corresponds to the free passage required for the disengagement of the locking sleeves for the resetting of the combination. In this way the corresponding unlocking function is blocked, since the simultaneous inward displacement, both of the actuating button and of the push button for the changing of the combination, leads only to a partial stroke which is not sufficient to open the loop.

Furthermore, as a structurally favorable development, the spring which acts on the locking sleeves is located on the setting-disk mounting shaft and rests at one end against the locking sleeves and at its other end against a shoulder of the latch tail which is supported by the setting-disk mounting shaft. It is furthermore advantageous that the spring which acts on the latch extends at one end into a shaft-like longitudinal recess in the back of the latch and, at its other end, rests against a transverse wall on the housing side. This spring can be optimally designed with respect to the latch function. The shaft-like longitudinal recess forms a spring chamber which excludes unintentional displacements. In this way reliability in operation is increased. On the other hand, the greater spring force of the latch is not capable, even in the case of a strongly extending latch, of impairing the displaceability of the latch since the spring lies in the region of correspondingly aligned longitudinal ledges on the housing side which are gripped over by lateral grooves of the latch. Such a slide guidance permits a compact construction of the latch.

In order to avoid indifferent stroke distribution upon the pushing in of the latch actuating button and the aforementioned push button leading to mutual interference with the two functions, when no stroke is carried out fully, it is furthermore proposed that there be associated with the push button an insertion niche formed by beveling the corner of the insertion housing. As a result of this development an actuation of the combination lock which is even more favorable in operation is achieved: the push button thus lies within the contour region of the lock housing where an exposed position is avoided. Rather, a large housing surface remains as finger support for the far more frequent actuation of the latch. A structurally advantageous development is obtained in the manner that the push button is developed as a flat slide and is inclined at an acute angle to the longitudinal central plane of the lock housing. A push button which is developed as a flat slide acts practically at the same time as an index pointer. Its alignment which is selected inclined at an acute angle to the longitudinal central plane of the lock housing furthermore results in greater visibility.

The further development that the center line of the setting-disk field extends in a plane lying at an acute angle to the longitudinal central plane of the lock housing leads to an advantageous displacement of the detent recess for the fields of the setting disks bearing the symbols. The detent springs can be imparted a greater lever arm length. They thereby become more elastic and therefore also facilitate the operation of the combination lock. In the case of detent springs made of extruded plastic it is necessary to start, as a rule, from a thickness of the spring arm of at least 0.8 mm. Excessively short spring arms produce too hard a detent engagement. The flat slide can furthermore also be made more visible by providing, adjoining the insertion niche, a channel into which a finger of the flat slide extends. A stable structural shape of the push button developed as a flat slide is present when the latter is developed in sleeve shape and has laterally directed guide wings. Finally, another advantageous feature of the invention resides in the fact that the rear flank of the flat slide extends flush with the adjacent rear of the lock housing.

BRIEF DESCRIPTION OF THE DRAWINGS

The object of the invention will be explained in further detail below with reference to two embodiments shown in the drawing, in which

FIG. 6 is an inner view of one half of the lock housing;

FIG. 7 shows the other half of the lock housing;

FIG. 8 is a section taken along line VIII—VIII of FIG. 6;

FIG. 9 is a side view of a second embodiment of the combination lock with loop, shown on a larger scale;

FIG. 10 is a top view thereof;

FIG. 11 is a view of the left end thereof;

DETAILED DESCRIPTION OF THE PREFERRED EMBODIMENTS

Figure 1:
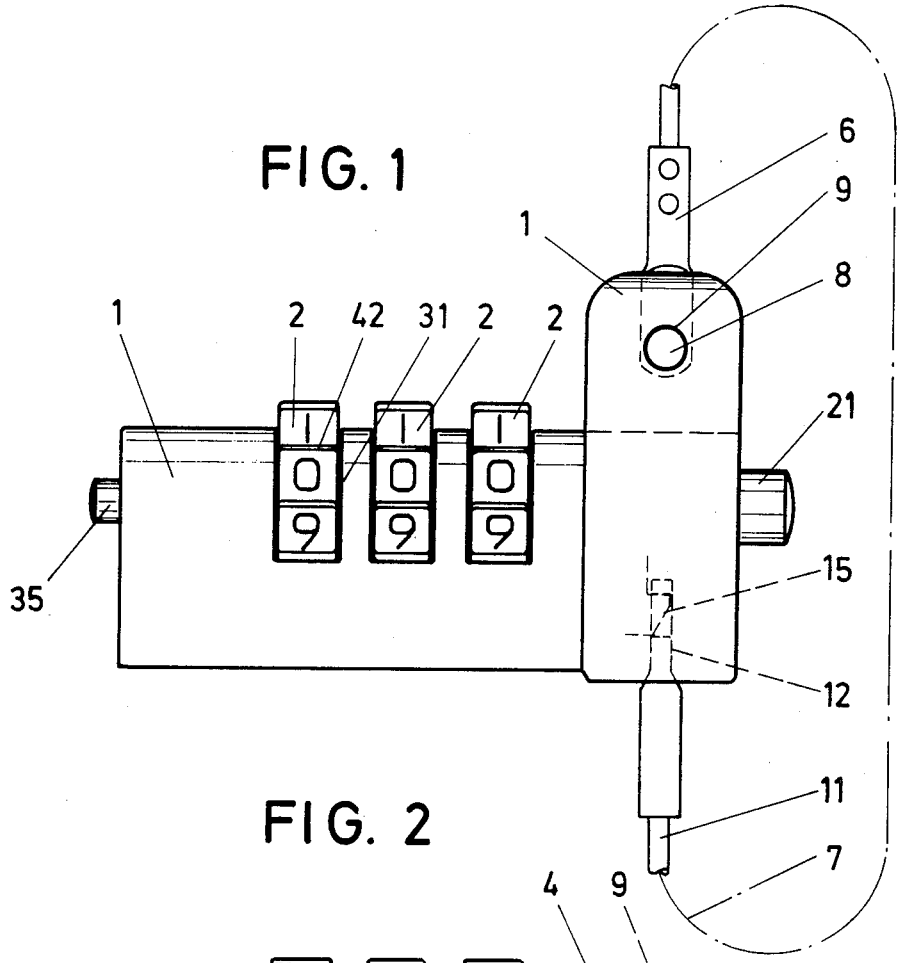
FIG. 1 is a side view of a first embodiment of the combination lock with loop, shown in larger than natural size.
Figure 2:
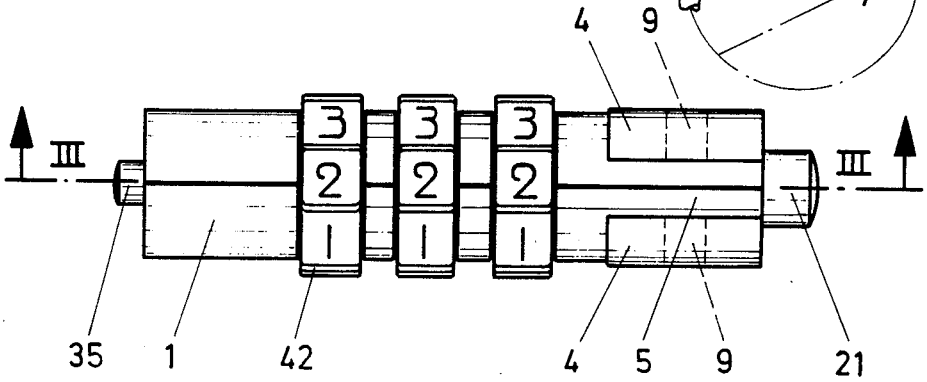
FIG. 2 is a top view thereof.

The combination lock of two embodiments of the invention has an elongated lock housing 1 which is substantially rectangular in cross section. The housing comprises a mounting shaft 3 bearing setting disks 2. The housing is transversely rounded at its upper portion, which portion bears shaft 3 (see FIGS. 4 and 11).

In the region of the right end of the housing of the first embodiment (FIGS. 1 to 8), the housing passes into transversely protruding pivot lugs 4. The latter are arranged in pairs. Their outer surface is also flush with the substantially flat parallel wide surfaces of the lock housing. The pivot lugs 4, which extend upward only on the housing right end, leave free between each other a slot 5 which is open along three adjacent sides. The slot receives an end 6 of a loop 7, which end is connected firmly to the lock housing 1. This attachment is effected by a rivet 8 or the like, which passes through coinciding transverse bores 9 in the pivot lugs 4 and an eyelet opening 10 in the fixed loop end 6. The loop end is formed by a sleeve which is flattened at one end to grip the rope-like loop 7. In the second embodiment (FIGS. 9 to 15) the lock housing 1 has in its left lower corner zone such a slot 5 with open edges.

In both embodiments, the other, free end 11 of the loop 7 can be inserted into a channel 12 in the lock housing 1. This free end is releasably grasped by a lock member.

Figure 5:
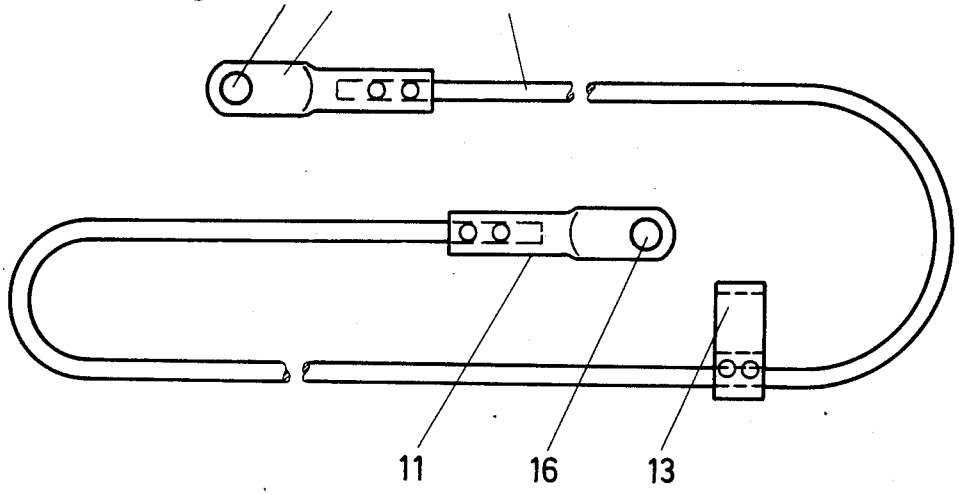
FIG. 5 shows the loop by itself.

The loop 7 bears an eye 13 seated firmly thereon (FIG. 5). This eye can receive the free end 11.

The insertion channel 12 is aligned transverse to the center line X—X of the mounting shaft 3 and is located, in both cases, spatially opposite the end of the loop 7 which is fastened to the lock housing. In the first embodiment, the loop is fastened to the housing at one side of the right end of the housing, while channel 12 is located on the opposite side of this right end. However, in the second embodiment, while channel 12 is again located on the right end of the housing, the loop is now fastened to the other end of the lock housing 1. In front of the channel 12 there is a receiving funnel 14. A latch 15 extends into the channel 12, extending transverse to the direction of insertion. The section thereof forming the latch nose 15' is circular, seen in cross section. The latch bevel on the receiving funnel side bears the reference number 15''. The bevel does not extend over the entire cross sectional region so that a circular end surface still remains on top. Adapted to the cross section of the latch nose 15' is an eye opening 16 of the free end 11 of the loop 7 which is also circular. However, other cross sectional shapes are also possible.

The latch 15 is seated and guided like a carriage on the end of the axially displaceable setting-disk mounting shaft 3. As can be noted from FIG. 4, the directly loaded lower section of the latch is specially guided on both sides on housing-side longitudinal ledges 17. These ledges are gripped over by grooves 18 of the latch 15. In the second embodiment, as can be noted from FIG. 14, the directly loaded lower section of the latch is guided on both sides in longitudinal grooves 47 on the housing side. Longitudinal ledges 48 of the latch 15 extend into them.

The latch 15 is under the action of a spring F1 which urges it in the direction towards a basic latching position. The spring F1, which is developed in the form of a helical compression spring, extends within a shaft-like longitudinal recess 19 in the back of the latch. The one end turn of the spring acts on the rear wall 19' of the latch while the other end turn rests against a transverse wall 1' in the lock housing 1. The longitudinal recess 19 is arched in tunnel shape on top and open towards the bottom. Below recess 19 there extends the bottom 1'' of the lock housing. In this way there is obtained a spring chamber which is closed on all sides. The latch spring F1 is designed in a manner corresponding to the manner of operation of the latch 15 and is aligned, in the second embodiment such that it lies in the region of the guide formed by the longitudinal ledges 48 and grooves 47. The longitudinal recess 19 extends vertically in the longitudinal center plane E—E of the lock housing 1.

A spring F2 is placed on the setting-disk mounting shaft 3. The spring in this case also is a helical compression spring. The spring force of the latter is less than the force of the latch spring F1 and acts on the lock member in the direction towards the basic latching position.

Figure 3:
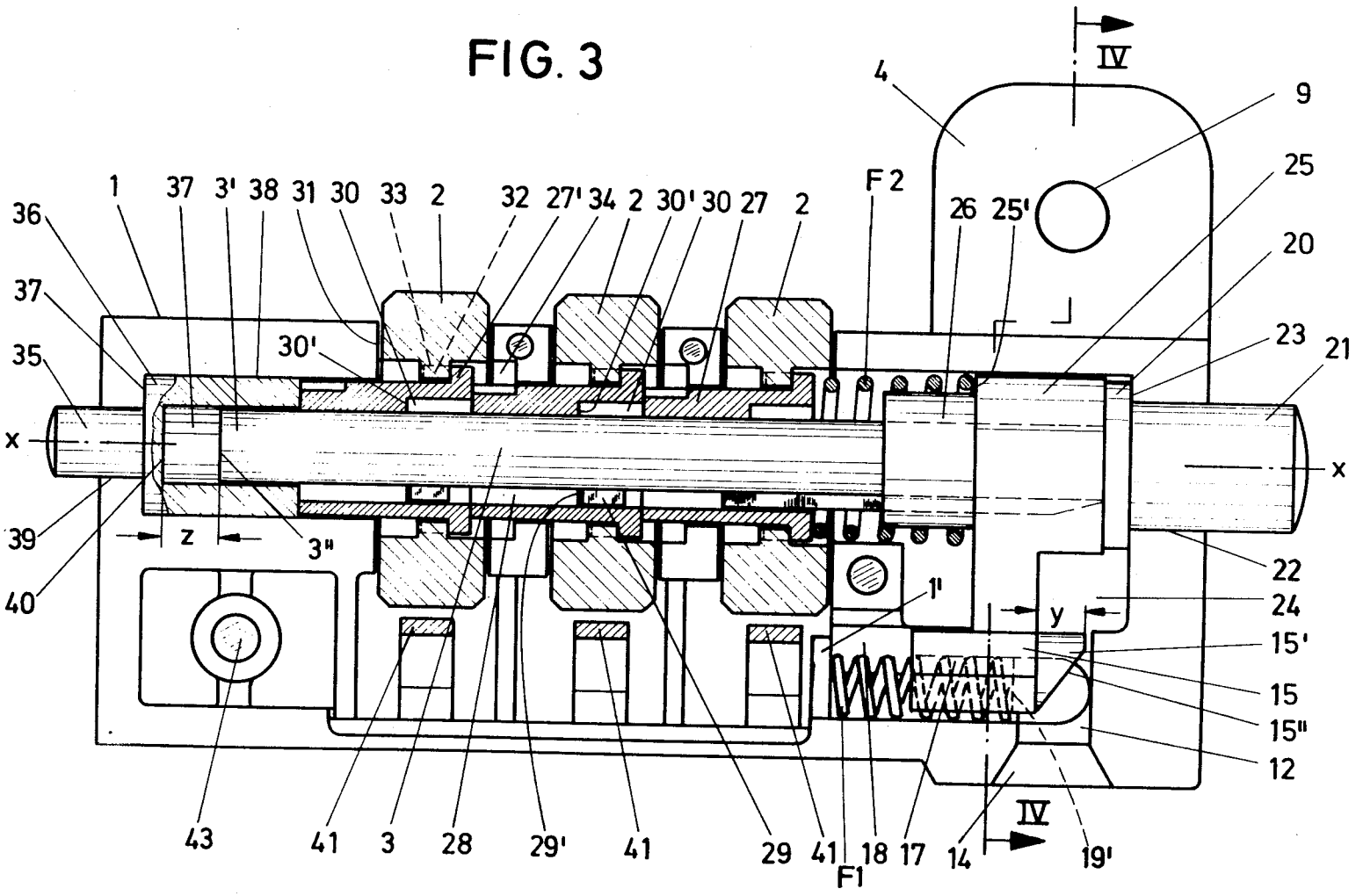
FIG. 3 is a section taken along line III—III of FIG. 2, on a larger scale than shown in FIG. 2.
Figure 12:
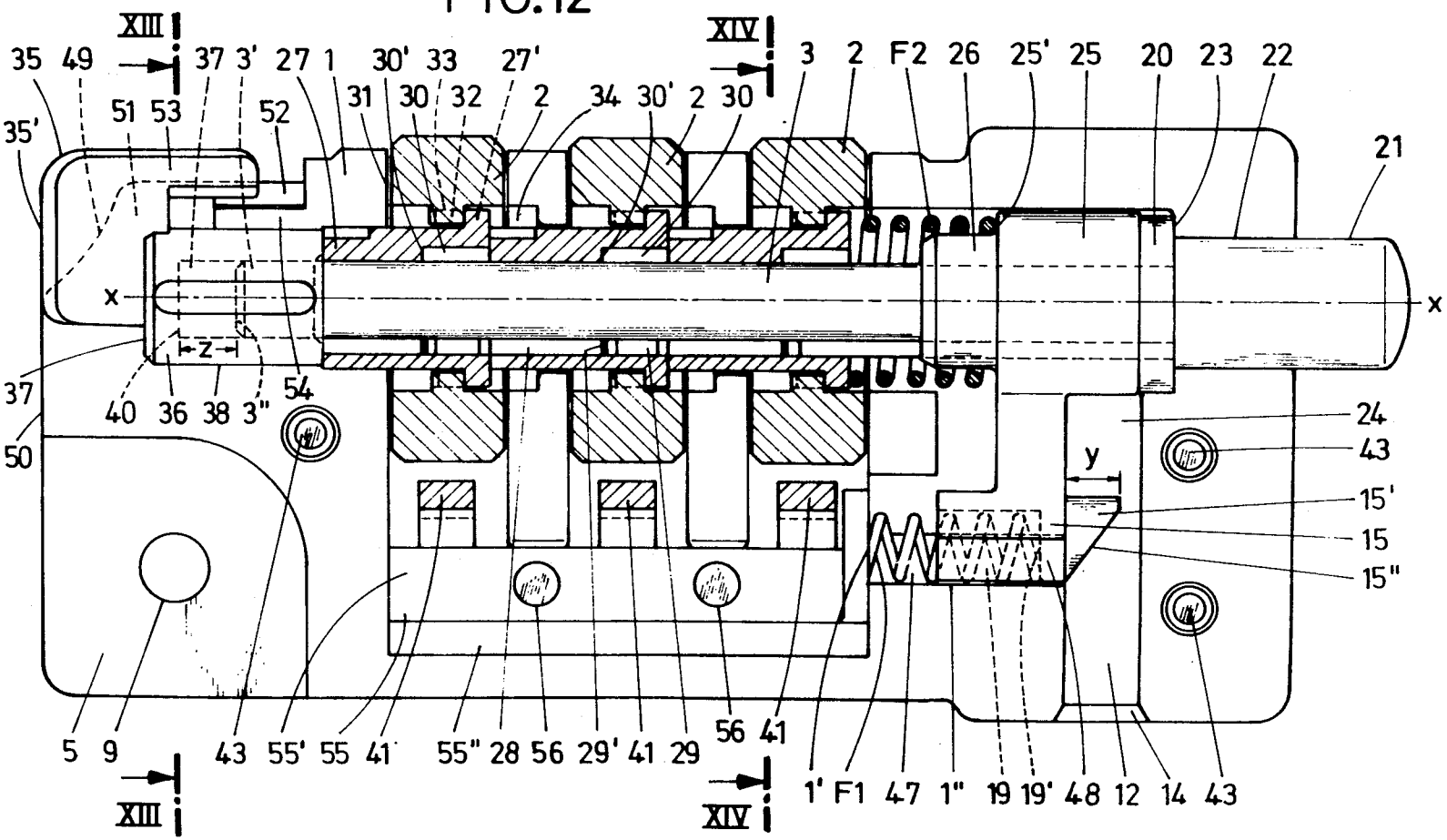
FIG. 12 is a section taken along line XII—XII of FIG. 10, shown on a far larger scale than in FIG. 10.

The setting-disk mounting shaft 3 can be disengaged via a collar 20 against the force of the latch spring F1 out of its basic position (FIGS. 3 and 12). The collar 20, which is in fixed association with the mounting shaft 3, is continued by an outwardly protruding actuating button 21. The latter is mounted for axial displacement in a guide 22 on the housing side. The collar 20 in its base position comes, limited by a stop, against a shoulder 23 on the housing side. The actuating button 21, which lies coaxial to the mounting shaft 3, is reduced in cross section with respect to the collar by an amount which corresponds approximately to the length of the collar. On the face of the collar 20 which points toward the inside of the housing there rests a widened latch tail 25 lying on the shaft side. In the opposite direction the latch tail is continued also into a sleeve-like collar 26 which centers or bears the spring F2. The face end of this collar 26 on the setting disk side extends at a distance from the first of a number of locking sleeves 27 of the lock ward which are arranged axially one behind the other, this distance corresponding at least to the latch actuating stroke y. The locking sleeves are arranged displaceably in contact with each other on the setting-disk mounting shaft and are also turnable in the basic position of the combination lock. They have longitudinally directed slot-like locking engagement spaces 28 for locking projections 29. The locking projections are seated, one behind the other in a row, firmly on the mounting shaft 3. In front of the locking engagement spaces 28, annular free spaces 30 arranged concentric to the cross section of the shaft are located on the inside of the locking sleeves. In the basic position the locking projections 29 extend within the region of the free spaces 30. The setting disks 2 which are coupled with the locking sleeves 27 can thus be turned freely on the mounting shaft 3.

Figure 4:
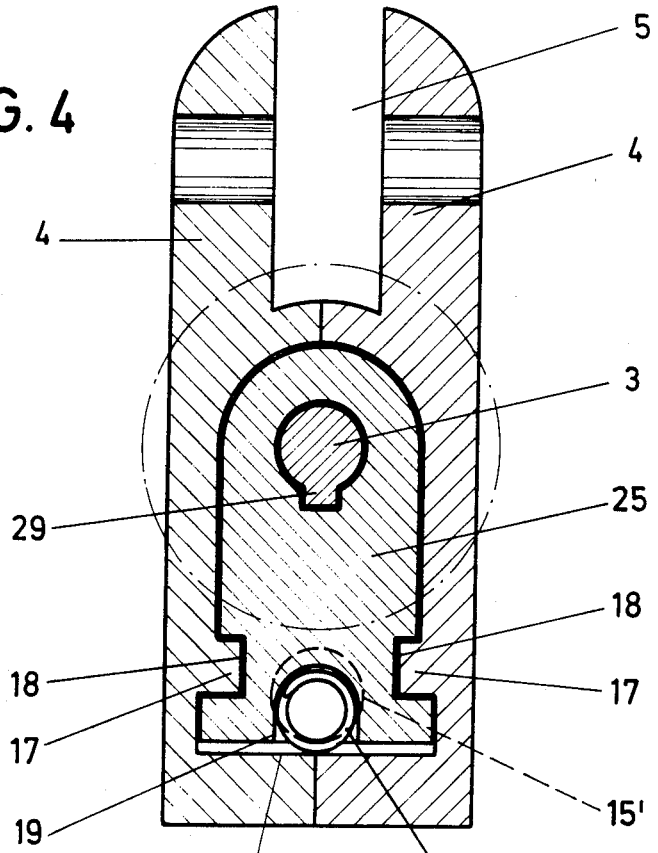
FIG. 4 is a section taken along line IV—IV of FIG. 3.

The setting disks 2, which are contained in transverse shafts 31 defined on the interior of the lock housing 1, have a part of their circumference protruding beyond the outer surface of the housing (see FIGS. 4 and 9). The coupling between locking sleeve 27 and the setting disk 2 associated with it is effected via disengageable engagement projections 32 on the locking sleeve side, which in known manner engage into corresponding recesses 33 of an inner toothing of the setting disk. The locking sleeves, which are all acted on by the spring F2 and developed with the same shape, are provided, within the region of their latch-side end, with a collar 27' via which they rest on the inner toothing ring of the setting disks 2 which forms the recesses 33.

All transverse shafts 31, of housing 1 have evasion spaces 34 on the latch-side shaft wall. The collar 27' of the locking sleeves 27 extends into said spaces in uncoupled position. In this uncoupled position the locking sleeve engagement projection 32 is also out of engagement with the disk recess 33. This disengagement takes place for the purpose of changing the combination and presupposes the positioning of the valid combination, i.e. the locking engagement spaces 28 of sleeves 27 must be in alignment with the locking projections 29 on shaft 3.

In the second embodiment, an insertion niche 49 formed by the beveling of the corner of the lock housing 1 is associated with the push button 35 (FIG. 12). The base of said niche has a concave rounding in which the fingertip which displaces the push button 35 against spring action comfortably fits.

The insertion niche commences on the rear wall 50 of the housing approximately at the height of the center line x—x and terminates on the top of the lock housing via a short rounding.

Figure 15:
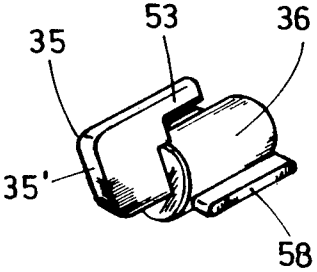
FIG. 15 is a perspective view of the push button by itself.

In the second embodiment, the push button 35 is developed as a flat slide (see perspective view of FIG. 15). Its thickness corresponds approximately to the diameter of the mounting shaft 3. In the basic latched position it fills the approximately triangular space of the insertion niche 49 and therefore lies essentially within the rectangular contour of the housing, at most protruding somewhat above it on the top. The rear flank 35' of the plate body of the push button 35 is flush with the rear 50 of the lock housing 1. In this way there is a continuous flat support for the finger which is to be applied of the operating hand, while another finger can conveniently depress the latch actuating button 21.

A channel 51 adjoins the insertion niche 49 into which the plate body of the push button extends. The axial depth of the channel takes into account the stroke for the displacement of the push button. In the vicinity of the top of the lock housing, the channel 51 passes into a channel section 52 into which a finger 53 pointing in the direction of the setting disks 2 extends.

The plate body of the push button 35 is continued on the inside of the lock housing by a collar 36. The latter is developed as a cup-shaped bushing. On its front edge there rests the corresponding front end of the locking sleeve 27 present there. The cylindrical inner space of the bushing, which extends somewhat beyond the finger 53, mounts over the free end 3' of the mounting shaft 3. The stop limitation of the sleeve-shaped collar in outward direction is established by the cross sectional difference between the plate body of the push button 35 and the sleeve-shaped collar 36. This leads to a shoulder 37 between the cylindrical housing recess 38 which provides the guidance of the collar 36 and the channel 51 guiding the plate body. Between the housing recess 38 and the channel section 52 there is a bridge of material 54 which is gripped over at a certain distance away by the finger 53. As a result of the bridge of material there is an enlarged peripheral guide surface for the collar 36. The plate body is rooted in the bottom of the cup-shaped collar 36, and above this junction forms a right angle with finger 53.

Laterally directed guide wings 58 extend from the collar 36 and move in grooves 59 on the housing side. The guide wings 58 furthermore contribute to the stabilizing of the collar 36.

For the eliminating of the corresponding coupling position between setting disks 2 and locking sleeves 27, push button 35 is coupled coaxially to the setting-disk mounting shaft on the side of the combination lock opposite the actuating button 21. The push button 35 protrudes freely, in accordance with the first embodiment, beyond the rear wall of the lock housing (FIG. 3).

As can be noted from FIGS. 3 and 12, the cup bottom 40 of the cup-shaped bushing lies at a distance z, corresponding to the latch actuating stroke y, in front of the front end 3'' present there of the setting-disk mounting shaft. If the combination is correctly set, the actuating button 21 can, as a result, be shifted, carrying the latch 15 along with it, in the direction of the release of the loop end 6.

The angular positions of the locking sleeves 27 and setting disks 2 are secured in position in each case by detent springs 41 which enter into notch-like detent depressions 42 distributed an equal angle apart on the circumference of the setting disks 2. As can be noted from FIG. 8, the detent springs 41 which are developed in the same material on a plastic insert are associated with one shell half of two shell halves coming against each other in the vertical longitudinal central plane E—E. The notches divide the cylindrical surface of the setting disks 2 into ten approximately square setting-disk fields a (see FIG. 10).

While the index line for the fields "a" in the case of the object of the first embodiment coincides with the vertical central plane E—E, in the case of the object of the second embodiment, an index line L1 is moved out of this plane as seen in FIGS. 10 and 11. Line L1 lies, as the flat push button finger also does, inclined at an acute angle (angle alpha) to the longitudinal center line E—E of the lock housing 1 in a plane E'—E' (see FIG. 13). The lock member is included in this indexing displacement. The indexing displacement corresponds to half a switch step, referred to the tens division, and therefore 18.5. The displacement of the center line L2 of the setting disk fields "a" in counterclockwise direction creates a favorable prerequisite for a greater lever for the detent springs 41 which pass from the bottom left to the top right through the partition joint and the inside of the lock housing. The detent springs extend from the upwardly directed arm 55' of a plastic insert 55 which is angular in cross section (see FIG. 14). Its other arm 55'' rests on the bottom of the lock housing. For securing in position, the insert 55 is placed or clipped on supporting pins 56. In the case of a lock housing which consists of plastic, the detent springs 41 can be developed directly on the one shell half (FIG. 8). In the region of the free end of the detent springs 41, the shell half has on the inside a partial reduction in the wall 57 which increases the spring evasion space (see FIG. 14).

The shell halves furthermore are provided on the one side with detent pins 43 which snap into aligned detent depressions 44 in possibly irreversible manner or are riveted therein in the event of a metal lock housing 1. Corresponding connecting elements are also provided in the region of the transverse shafts 31 as well as in the vicinity of the latch. However, there may also be concerned welding cones and depressions or welding arms and grooves for ultrasonic welding if the lock housing 1 consists of plastic.

The function of the combination lock is, briefly speaking, the following: For the closing of the loop 7 serving, for instance, for the securing of skis or bicycles, the free end 11 of said loop is inserted into the channel 12, the latch nose 15 moving out against the latch spring biasing, regardless of whether the combination is correctly set or not.

Figure 14:
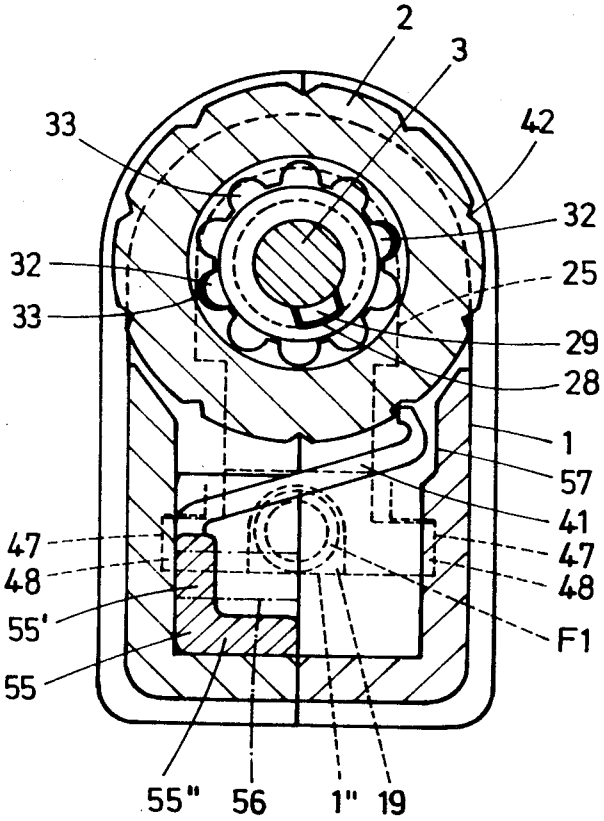
FIG. 14 is a section along the line XIV—XIV of FIG. 12.
Figure 13:
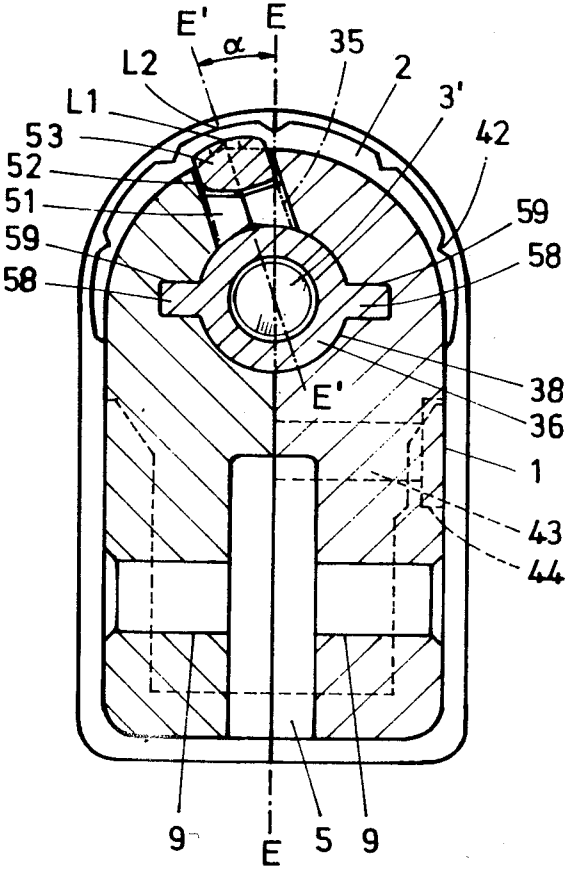
FIG. 13 is a section along the line XIII—XIII of FIG. 12.

A knowledge of the combination is required for the release of the free end 11. The user must so set the setting disks 2 that the lock engagement spaces 28 are aligned with the fixed-axis locking projections 29 (FIG. 14). If this is so, then the shaft 3 can be displaced by depressing the actuating button 21. The collar 20 then carries the latch tail 25 along with it and also the latch 15, against the force of the latch spring F1. The end 11 of the loop 7 becomes free.

On the other hand, if at least one of the locking sleeves 27 has been turned by the setting disk 2, which is provided on its circumference with numerical symbols, then the opening movement is blocked. This takes place in the manner that the front end 29', facing away from the latch, of the locking projection 29 comes against the annular shoulder 30' of the free spaces 30 which are open towards the latch side.

In order to change the combination, all locking sleeves 27 are shifted via the push button 35 in the direction of the latch 15, this being done against the force of the relatively weaker spring F2. In this connection the engagement projections 32 on the locking sleeve side are lifted out of the corresponding disk recess 33. The setting disk 2 can now be turned and a new combination digit thus selected. The number of recesses 33 corresponds to the setting-disk symbols and in the present case therefore to a division by ten.

After completion of the new coding the user need merely again release the push button 35 which has been pushed in by the distance z. The locking-sleeve spring F2 pushes it again into its stop-limited basic position. Thereupon the distance for the displacement of the shaft which corresponds to the latch-actuating stroke y is again present.

The locking projection 29 which cooperates with the latch-side setting disk 2 or locking sleeve 27 is continued in a corresponding longitudinal groove of the latch tail 25 and thus brings about the mounting-correct alignment of the latch 15 on the mounting shaft 3.

I claim:

1. In a combination lock adapted for securing skis, bicycles and the like, having a lock housing in which setting disks for setting a lock combination are rotatably supported and from which housing there extends fixed thereto, one end of a loop, the other, free end of which is insertable into an insertion channel in the lock housing and is engageable by a lock member, the improvement comprising a setting-disk mounting shaft, said setting disks are mounted on said mounting shaft, and a collar on said shaft, an actuating button inwardly extending into the lock housing and being for actuation when the combination is correctly set, said shaft extending from said inwardly extending actuating button, said lock member includes a latch located within said insertion channel for catching said free end of the loop, means for spring biasing said latch, said latch is operatively mounted on said shaft, displaceable against said spring biasing, said collar comprises means for disengaging said latch when the lock combination is correctly set by displacement of said collar together with said shaft upon actuation of said actuating button, means including a push button for changing the lock combination and locking sleeves releasably cooperating with said setting disks and being guided displaceably on said shaft, spring means for spring biasing said sleeves, said push button is coaxial with said shaft and mounted on a side of said lock housing opposite said actuating button, said push button extends into a push button collar, said push button collar being located on an inner side of the lock housing and resting against an end one of said spring-biased locking sleeves, and said push button collar is formed as a cup-shaped bushing, a front end of said shaft is mounted in said cup-shaped bushing, a bottom of said bushing lying spaced at a distance from the front end of said shaft, said distance corresponding to an actuating stroke of the latch.

2. The combination lock according to claim 1, wherein the fixed one end of said loop is fastened to said lock housing opposite said insertion channel.

3. The combination lock according to claim 1, further comprising said member includes a latch tail mounted on said shaft constituting the operative mounting of said latch on said shaft, said spring means for spring biasing said sleeves is located on said shaft and rests against a first of the locking sleeves and against said latch tail.

4. The combination lock according to claim 1, wherein a side of said housing defines a transverse wall and said latch defines a shaft-like longitudinal recess in a back of the latch, said spring means for spring biasing said latch extends at one end thereof into said recess and resting at its other end against said transverse wall.

5. The combination lock according to claim 4, wherein said latch further defines lateral grooves therein, said housing has longitudinal ledges, and wherein said spring means lies within the region of said longitudinal ledges, said ledges are aligned with and relatively slidably guided in said lateral grooves.

6. The combination lock according to claim 1, wherein said lock housing has a beveled corner defining an insertion niche, said push button is coordinated to said insertion niche of said lock housing.

7. The combination lock according to claim 6, wherein said push button comprises a flat slide, said slide is inclined at an acute angle relative to a longitudinal center plane of the lock housing.

8. The combination lock according to claim 6, wherein said setting disks define fields having a center line, said line extends in a plane lying at an acute angle relative to a longitudinal central plane of the lock housing.

9. The combination lock according to claim 6, wherein said push button further comprising a flat slide, said slide defining a finger thereon, said housing defining at least one channel adjoining said insertion niche, and said finger extends into said channel.

10. The combination lock according to claim 6, wherein said housing is formed with grooves, said push button collar further has a sleeve shape and has laterally directed guide wings slidably guided in said grooves.

11. The combination lock according to claim 6, wherein said slide defines a rear flank, said flank extending flush with a rear of the lock housing.

12. The combination lock according to claim 6, wherein said disks define depressions, said lock further comprising extruded plastic detent springs, said springs have arms cooperating with said depressions.

* * * * *